US006457623B1

(12) United States Patent
Rey

(10) Patent No.: US 6,457,623 B1
(45) Date of Patent: Oct. 1, 2002

(54) ROLL QUADRANT WITH STRIP CENTERING ACTION

(76) Inventor: Giorgio A. Rey, 2302 Colony Ct., Pittsburgh, PA (US) 15237

( * ) Notice: Subject to any disclaimer, the term of this patent is extended or adjusted under 35 U.S.C. 154(b) by 0 days.

(21) Appl. No.: 09/459,231

(22) Filed: Dec. 10, 1999

Related U.S. Application Data

(60) Provisional application No. 60/118,482, filed on Feb. 3, 1999.

(51) Int. Cl.[7] ..... B65H 20/00; B65H 23/32

(52) U.S. Cl. ..... 226/189; 226/190; 242/615.21; 198/785

(58) Field of Search ..... 242/615.21, 615.1; 226/189, 190; 198/785

(56) References Cited

U.S. PATENT DOCUMENTS

| | | | | | |
|---|---|---|---|---|---|
| 1,863,520 | A | | 6/1932 | Camerota | |
| 2,592,581 | A | | 4/1952 | Lorig | 226/3 |
| 2,593,157 | A | * | 4/1952 | Lorig | 198/785 X |
| 2,593,158 | A | * | 4/1952 | Lorig | 198/785 X |
| 2,682,333 | A | * | 6/1954 | Orr | 195/785 |
| 2,692,773 | A | | 10/1954 | Lorig | 226/192 |
| 2,828,852 | A | * | 4/1958 | Lorig | 198/785 |
| 3,763,992 | A | | 10/1973 | Klenk | 198/785 |
| 4,541,557 | A | * | 9/1985 | Fell et al. | 226/615.1 X |
| 4,643,013 | A | | 2/1987 | Blazevic | 72/252 |
| 5,472,080 | A | * | 12/1995 | Fukuoka | 198/785 X |

FOREIGN PATENT DOCUMENTS

| | | | |
|---|---|---|---|
| DE | 3826638 | * 12/1989 | 198/785 |
| FR | 1191028 | 10/1959 | |
| JP | 4-228224 | * 8/1992 | 226/189 |

OTHER PUBLICATIONS

Kramer, Walter. "Transporteur a Rouleaux, Notamment Transporteur de Stockage Pour Laminoirs." Brevent I'lnvention. Oct. 1959. Gr. 5, Cl. 6, No. 1.91.028.*

* cited by examiner

*Primary Examiner*—Michael R. Mansen
*Assistant Examiner*—Minh-Chau Pham
(74) *Attorney, Agent, or Firm*—Webb Ziesenheim Logsdon Orkin & Hanson, P.C.

(57) ABSTRACT

A roll quadrant conveyor for conveying strip material generally includes a plurality of support members for supporting a plurality of rolls around a quadrant roll of any desired wrapping angle and, further, a plurality of rolls journaled for rotation in the support members. The rolls are positioned on opposed sides of a conveyor centerline, with each roll positioned at an angle of less than 90° with the conveyor centerline. The rolls define a chevron pattern around the wrapping angle. The strip material, in motion, is centered on the conveyor by the rolls arranged in the chevron pattern. The rolls are profiled rolls.

20 Claims, 9 Drawing Sheets

ROLL QUADRANT WITH STRIP CENTERING ACTION

CROSS REFERENCE TO RELATED APPLICATION

This application claims the benefit of U.S. Provisional Application Serial No. 60/118,482 filed Feb. 3, 1999, entitled "Roll Quadrant With Strip Centering Action".

BACKGROUND OF THE INVENTION

1. Field of the Invention

The present invention generally relates to deflector rolls for conveying strip material and, more particularly, to quadrant roll conveyors with strip centering action for conveying strip material.

2. Description of the Prior Art

In the relevant industry, "quadrant rolls" or "basket rolls" have been used to replace deflector rolls and, in particular, deflector rolls of large diameter. A quadrant roll or basket roll unit is normally an assembly of small diameter rolls mounted on two side frames, with the rolls positioned on the theoretical contour of a sector, or quadrant, of the deflector roll to be replaced. FIG. 1 shows a typical deflector roll 2 and a typical quadrant or basket roll unit 4 intended to replace the deflector roll 2.

It is known in the art to position rolls in horizontal roll conveyors in a "herringbone" or "chevron" configuration. A typical herringbone-type horizontal roll conveyor is disclosed by U.S. Pat. No. 1,863,520 to Camerota. The horizontal roll conveyor disclosed by the Camerota patent includes two sets of oppositely facing rolls, with each set of rolls inclined at an angle relative to a centerline of the horizontal (flat) roll conveyor. The Camerota patent further discloses that the herringbone-type configuration provides a centering action to objects carried by the horizontal roll conveyor. In the case of the Camerota patent, the objects to be transported are cylindrical-shaped objects such as metal pipe. The rolls in the horizontal roll conveyor disclosed by the Camerota patent are driven.

FIG. 2 of the present application illustrates the principle behind the self-centering action provided by a horizontal roll conveyor with herringbone-arranged rolls. FIG. 2 is a plan view schematically showing a typical herringbone-type horizontal roll conveyor designated by reference numeral 10. A plurality of cylindrical rolls 12 is positioned to the left and right side of centerline A—A of the horizontal roll conveyors 10. Each of the rolls 12 is positioned at an angle β relative to the centerline A—A of the horizontal roll conveyors 10. A strip 14, such as a metal strip, is positioned on the rolls 12. In FIG. 2, the strip 14 is shown centered to the centerline A—A of the horizontal roll conveyors 10.

Generally, if the strip 14 is centered on the horizontal roll conveyors 10, the weight of the left side of the strip 14, designated by reference numeral 16, is equal to the weight of the right side of the strip, designated by reference numeral 18. Consequently, the weight of the strip 14 resting on the left and right side rolls 12 is the same. When the strip 14 is in running condition and centered, the rolls 12 generate on the strip 14 identical horizontal and opposite forces $F_2$ and $H_2$. Forces $F_2$ and $H_2$ are proportional to the weight of the strip 14 resting on the rolls 12 and the frictional coefficient between the strip 14 and the rolls 12, as is well known in the art. When the strip 14 is not centered with the centerline A—A of the horizontal roll conveyors 10, the rolls 12 generate opposite but unequal forces $F_2$, $H_2$, which result in a concurrent centering action urging the strip 14 to a centered position on the horizontal roll conveyors 10. $V_1$ in FIG. 2 represents the direction of travel of the strip 14. In FIG. 2, reference character F represents the force acting on the left side 16 of the strip 14, with reference characters $F_1$, $F_2$ representing the vector components of force F. Likewise, reference character H represents the force acting on the right side 18 of the strip 14, with reference characters $H_1$, $H_2$ representing the vector components of force H, as will be appreciated by those skilled in the art.

Heretofore, the above-discussed "herringbone" or "chevron" principle has not been applied to quadrant roll conveyors, also known as "basket roll units", where the weight of the strip 14 in FIG. 2 (i.e., the pressure of the strip 14 on the rolls 12) is replaced by strip tension, generating pressure on the rolls. In a quadrant roll with chevron rolls, as strip tension increases also pressure and centering forces increase. In a flat, horizontal roller conveyor as strip tension increases, pressure on the roll is less with less centering effect.

The present invention has as its object to provide a quadrant roll conveyor with strip centering action for conveying strip material.

SUMMARY OF THE INVENTION

The present invention is a quadrant roll conveyor for conveying strip material, such as metal, plastic or paper. The conveyor generally includes at least three substantially parallel support members on a frame for supporting a plurality of rolls around a quadrant roll of any desired wrapping angle, with the intermediate support members positioned on the center of the strip conveying system. The quadrant roll conveyor further includes a plurality of rolls, with each of the rolls journaled for rotation in the support members. The rolls are positioned on opposed sides of the conveyor centerline. The rolls are each positioned at an angle of less than 90° with the conveyor centerline to define a chevron pattern around the wrapping angle. The strip material is displaced in center position on the conveyor by the rolls or pushed to the center each time the strip is out of center.

The rolls are preferably rounded or crowned along the longitudinal centerline, but may also be tapered. The rolls may also have a first portion in the longitudinal direction that is cylindrical and a second portion in the longitudinal direction that is tapered.

Additionally, the rolls may be positioned on the opposed sides of the conveyor centerline such that each roll has an axis of rotation intersecting the axis of rotation of a corresponding roll located on the opposite side of the conveyor centerline. The axes of rotation of the oppositely facing rolls preferably intersect at a point in vertical plane passing through the conveyor centerline. Alternatively, the rolls could be mounted with staggered chevrons.

Further details and advantages of the present invention will become apparent from the following detailed description in conjunction with the drawings, wherein like reference characters identify like parts throughout.

DETAILED DESCRIPTION OF THE PREFERRED EMBODIMENTS

Horizontal roll conveyors for conveying strip material in which the weight of the strip material is supported by a plurality of horizontal rolls are well-known in the art. Additionally, it is well-known in the art to position the horizontal rolls at an angle of less than 90° relative to a centerline of the horizontal roll conveyor resulting in a "herringbone" or "chevron" configuration. The herringbone configuration, as previously discussed, provides a centering action to the strip material positioned on the horizontal rolls. The present invention incorporates the self-centering action of the herringbone configuration in a quadrant roll conveyor, also known as a "basket roll" conveyor. The Applicant has found that the self-centering advantage of the herringbone configuration can be applied to quadrant roll conveyors by using straight cylindrical rolls or profiled rolls, such as crowned rolls, in the quadrant roll conveyors. The uncertain pressure on rolls, due to the weight of the strip and related tension on a horizontal conveyor, is now replaced by pressure due to designed strip tension.

Figure 14A:
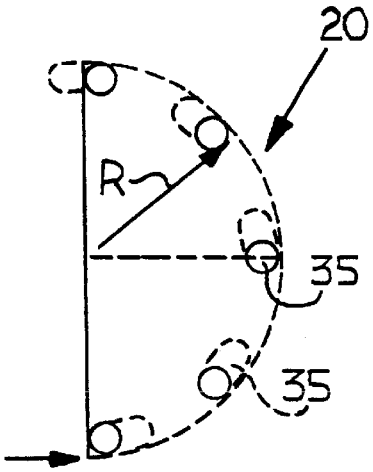
FIG. 14*a* is a side view schematically showing a quadrant roll conveyor made in accordance with the present invention and having prior art straight cylindrical rolls.
Figure 14B:
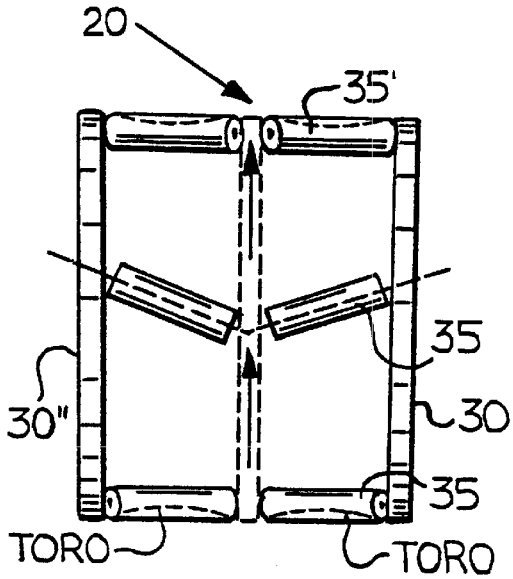
FIG. 14*b* is a plan view of the quadrant roll conveyor of FIG. 14*a;*

Referring briefly to FIGS. 14*a* and 14*b*, discussed more fully hereinafter, it will be apparent that straight cylindrical rolls 35, when assembled with a relatively large angle , will generate in a quadrant roll conveyor two TORO-cylindrical surfaces as shown in FIG. 14*b*. To avoid this inconvenience, which could damage a strip of material (not shown) positioned on the straight cylindrical rolls 35, the straight cylindrical rolls 35 may be crowned in accordance with the present invention to generate a perfect straight cylindrical surface as shown, for example, in FIG. 16*b*. Additionally, to increase the centering forces acting on the strip of material, it is possible to crown only half the faces of the "herringbone" or "chevron" arranged rolls (the inside facing portions), which will generate a semicircular or quadrant roll having a straight cylindrical surface with two (2) partial TOROs on the lateral sides of the quadrant roll conveyor as shown, for example, in FIG. 18*b*. With this background, I now refer to FIGS. 3–5 of the drawings.

Figure 3:
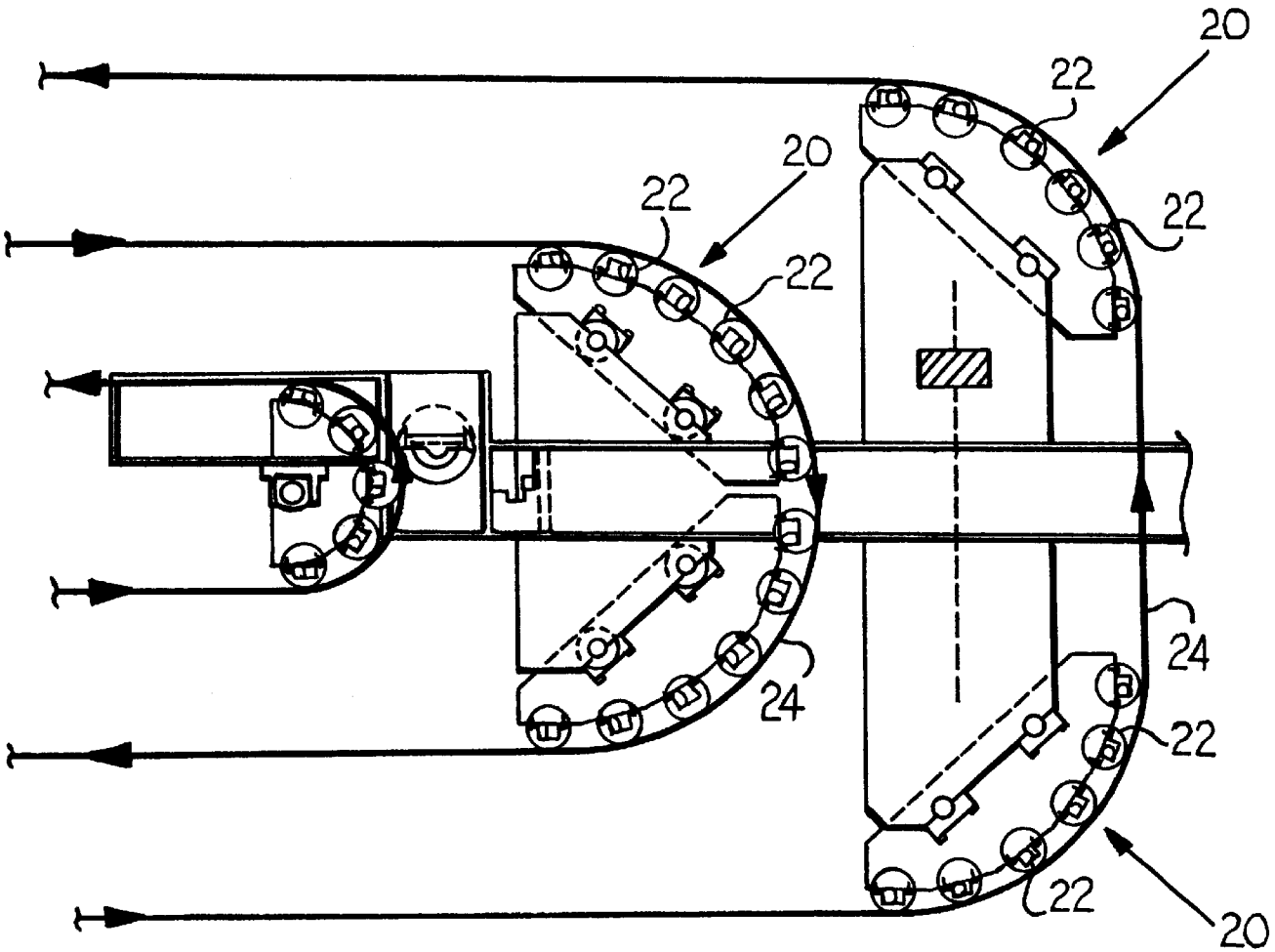
FIG. 3 is a side view of a plurality of quadrant roll conveyors made in accordance with the present invention and applied in a horizontal looper car with six (6) strip strands.
Figure 4:
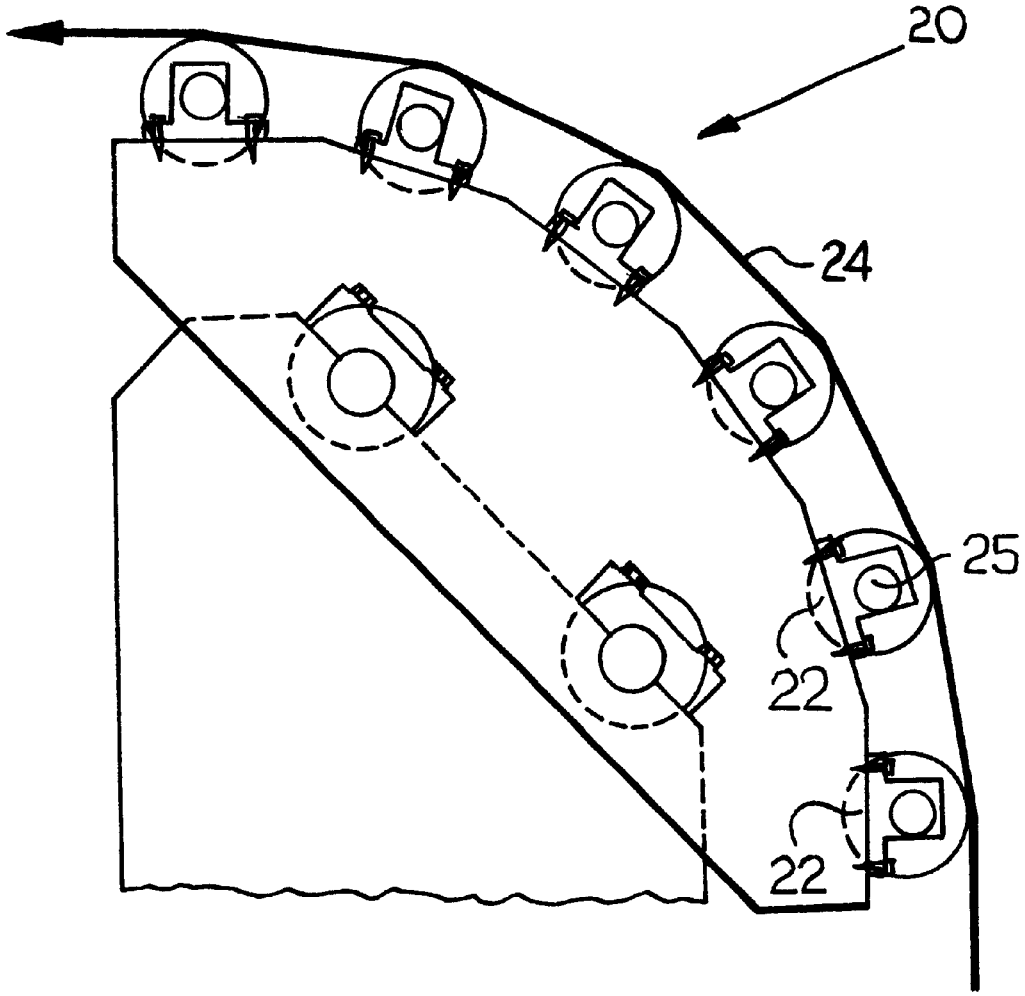
FIG. 4 is a side view of one of the quadrant roll conveyors shown in FIG. 3.
Figure 5:
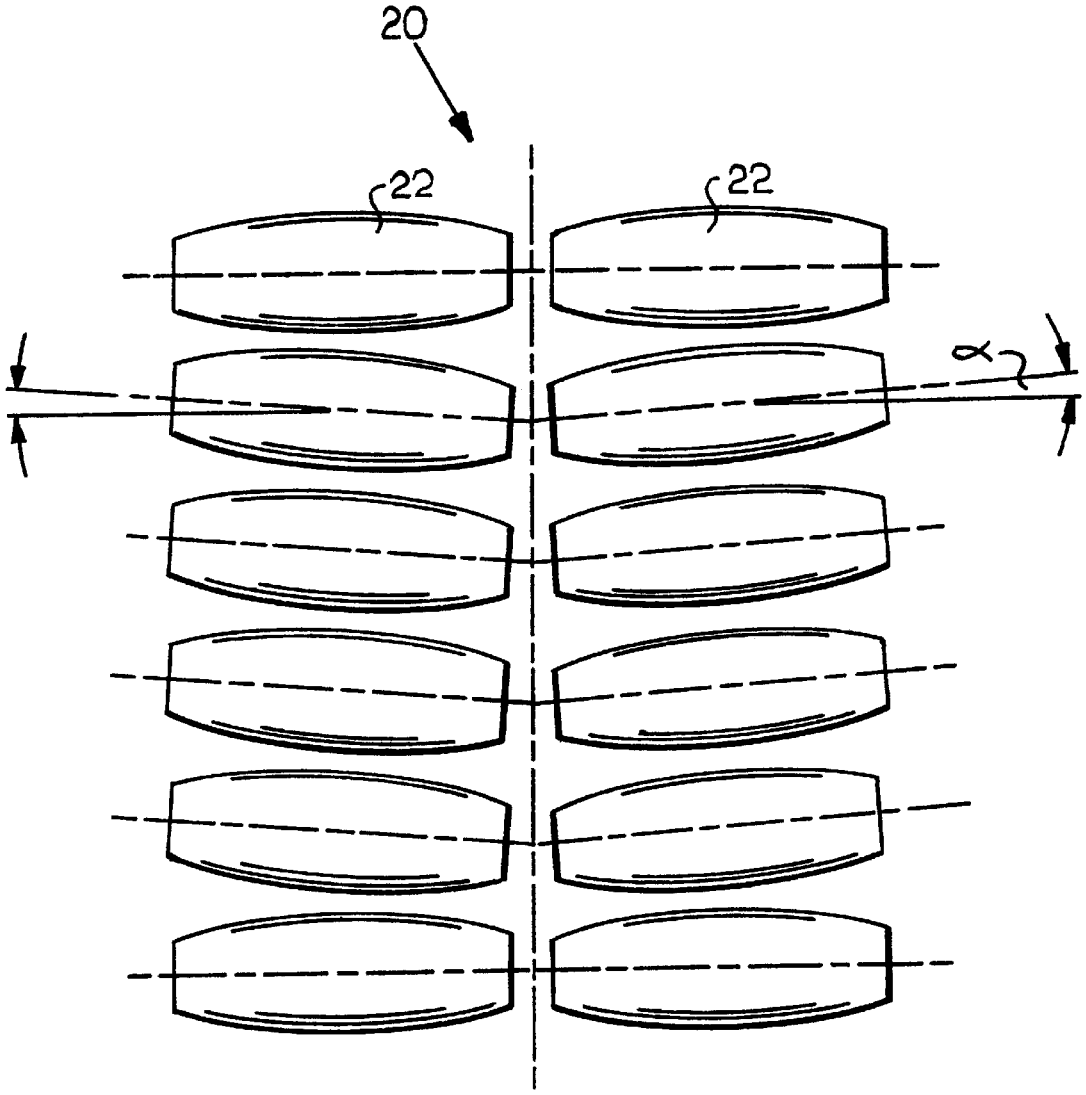
FIG. 5 is a plan view schematically showing one of the quadrant roll conveyors shown in FIG. 3 and having crowned rolls in accordance with the present invention.

FIGS. 3–5 generally show quadrant roll conveyors 20 made in accordance with the present invention. The quadrant roll conveyors 20 shown in FIG. 3 include a 180° quadrant roll conveyors 20 defining a semicircular quadrant arc or semicircular quadrant roll and two (2) 90° quadrant roll conveyors 20 each defining a 90° quadrant arc or quadrant roll. The terms "quadrant arc" and "quadrant roll" are used interchangeably hereafter to generally refer to the wrapping angle defined by the respective quadrant roll conveyors 20. The present invention is not intended to be limited to quadrant roll conveyors 20 that define wrapping angles of 180° or 90° only, but is intended to include quadrant roll conveyors 20 that define any desired wrapping angle between 0° and 270°.

The quadrant roll conveyors 20 are used for the transport of strip material, such as metal strip, along a conveying path and to change its direction of travel. These units may replace known steering roll units. Examples of typical conveyor applications for the quadrant roll conveyors 20 include galvanizing lines, pickling lines and the like in continuous strip processing plants. The quadrant roll conveyors 20 usually have a plurality of rolls 22 arranged in a semicircular (180°) arc or quadrant (90°) arc configuration such that the surfaces of the rolls 22 define the wrapping angle around which a strip 24 travels. In contrast to the horizontal roll conveyors previously discussed in which the weight of the strip 24 is carried by the horizontal rolls, in the quadrant roll conveyors 20, tension in the strip 24 is balanced by the action of the rolls 22, as is known in the art. The rolls 22 each have a shaft 25 for rotatably mounting the respective rolls 22 to a support, as discussed hereinafter in connection with FIG. 12.

Figure 6:
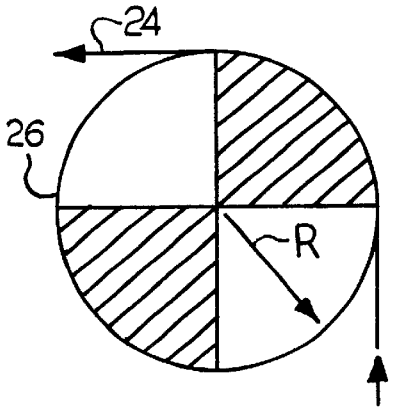
FIG. 6 PRIOR ART
FIG. 6 is a side view schematically showing a prior art 90° deflector roll/steering roll (remote pivot)
Figure 7:
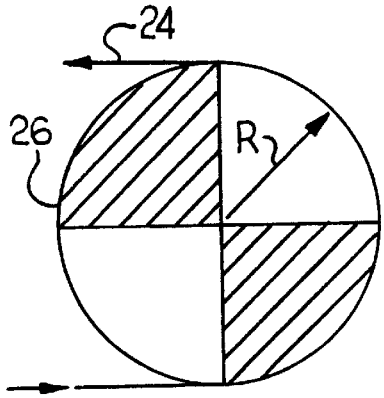
FIG. 7 PRIOR ART
FIG. 7 is a side view schematically showing a prior art 180° deflector roll/steering roll (remote pivot)
Figure 8:
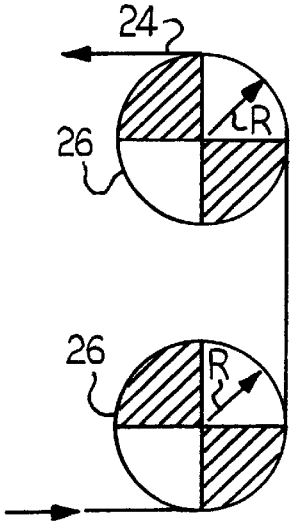
FIG. 8 PRIOR ART
FIG. 8 is a side view schematically showing a prior art 180° deflector roll/steering roll (displacement type)

Referring now to FIGS. 6–11, in typical applications in which a change in the direction of travel of strip material and its centering are required, a unitary steering roll 26, shown schematically in FIGS. 6–8, has generally been provided for these purposes. The quadrant roll conveyors 20, shown schematically in FIGS. 9–11 and made in accordance with the present invention, are intended to replace the unitary steering rolls 26 shown in FIGS. 6–8, respectively. The unitary steering rolls 26 of the prior art require costly tilting mechanisms (not shown) with associated sensors and controls to maintain the strip 24 in a centered mode of travel. The quadrant roll conveyors 20 of the present invention eliminate the need for these costly prior art devices.

Figure 13:
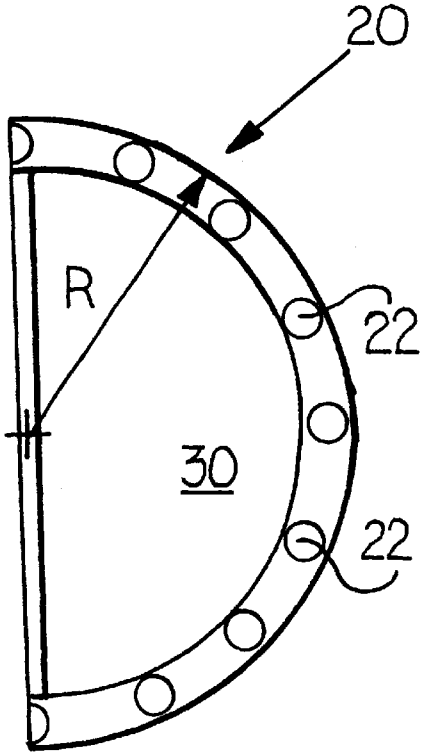
FIG. 13 is a side view of the quadrant roll conveyor of FIG. 12.
Figure 12:
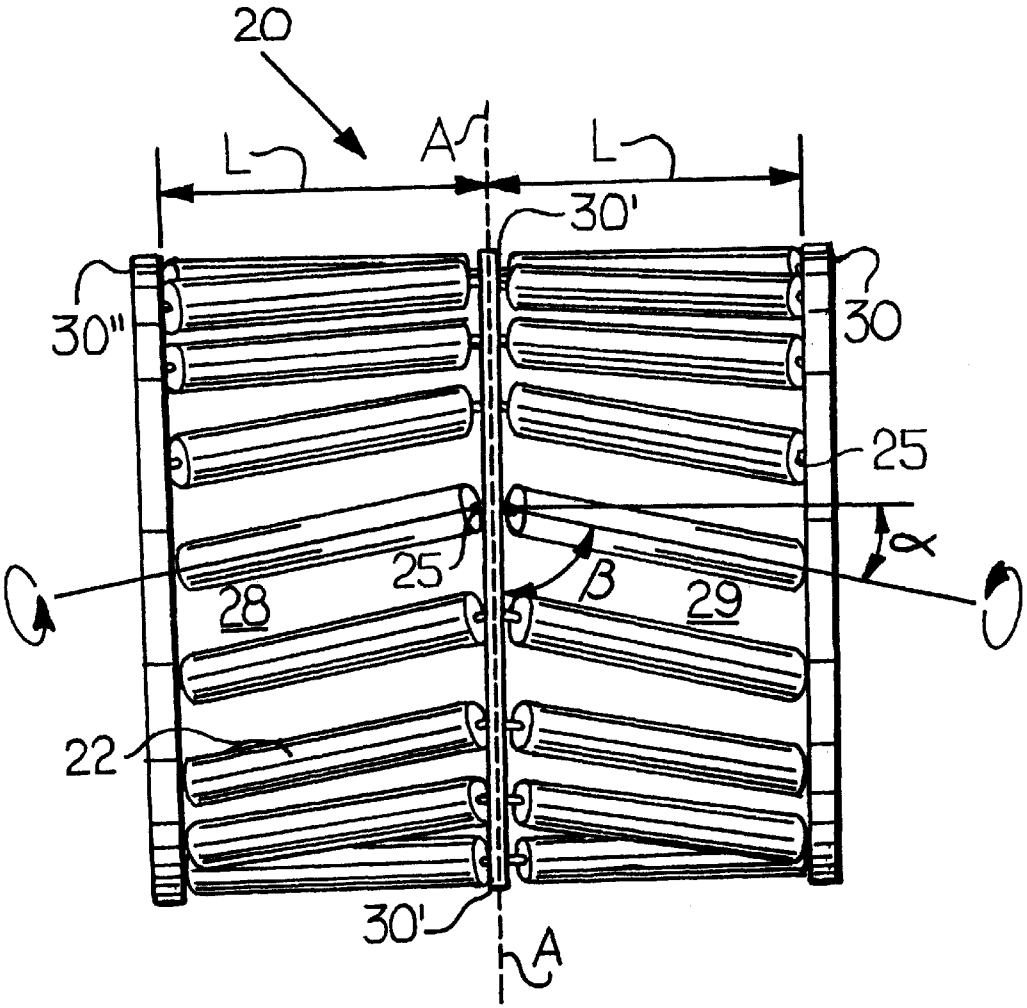
FIG. 12 is a front view schematically showing the quadrant roll conveyor of FIG. 10.

Referring to FIGS. 12 and 13, a typical quadrant roll conveyors 20 (hereinafter "the conveyors 20") made in accordance with the present invention will now be discussed in greater detail. The rolls 22 are positioned to left and right sides 28, 29 of a centerline A—A of the conveyors 20. The ends of the shaft 25 of each of the rolls 22 are journaled in two of three substantially parallel support members 30, 30' and 30". The support member 30' is positioned in the center of the conveyors 20 and is preferably coaxial with the centerline A—A thereof. The shafts 25 of the respective rolls 22 each define an angle β with the conveyor centerline A—A. The angle β is less than 90° and, thus, the rolls 22 are arranged in the herringbone or chevron configuration previously discussed. In the preferred embodiment, the rolls 22 are not driven. However, driven rolls 22 may be provided in the conveyors 20.

The rolls 22 are positioned on the left and right sides 28, 29 of the conveyor centerline A—A such that the shafts 25 of the respective rolls 22 each have an axis of rotation intersecting the axis of rotation of the corresponding shaft 25 and, hence, roll 22 located on the opposite side of the conveyor centerline A—A. The axes of rotation of each pair of oppositely facing rolls 22 intersect at a point located on the conveyor centerline A—A. More particularly, each pair of oppositely positioned rolls 22 has axes of rotation that intersect at a point located in a vertical plane passing through the conveyor centerline A—A and the central roll support member 30'. A staggered chevron arrangement for the rolls 22 is also envisioned by the present invention. In this embodiment (not shown), the axes of rotation of the shafts 25 of the oppositely positioned rolls 22 do not intersect.

Metal strip (not shown) may be positioned on the surface of the rolls 22 and carried thereby. The conveyors 20, with the rolls 22 (i.e., shafts 25) forming the angle β with the conveyor centerline A—A, provides better centering action then the herringbone arrangement previously discussed in connection with horizontal roll conveyors, but over a semicircular (180°) arc or quadrant (90°) arc rather than in a horizontal plane. Additionally, the conveyors 20 is able to deflect the strip 24 in the manner previously discussed in connection with the deflector rolls 26, shown in FIGS. 6–8

Figure 1:
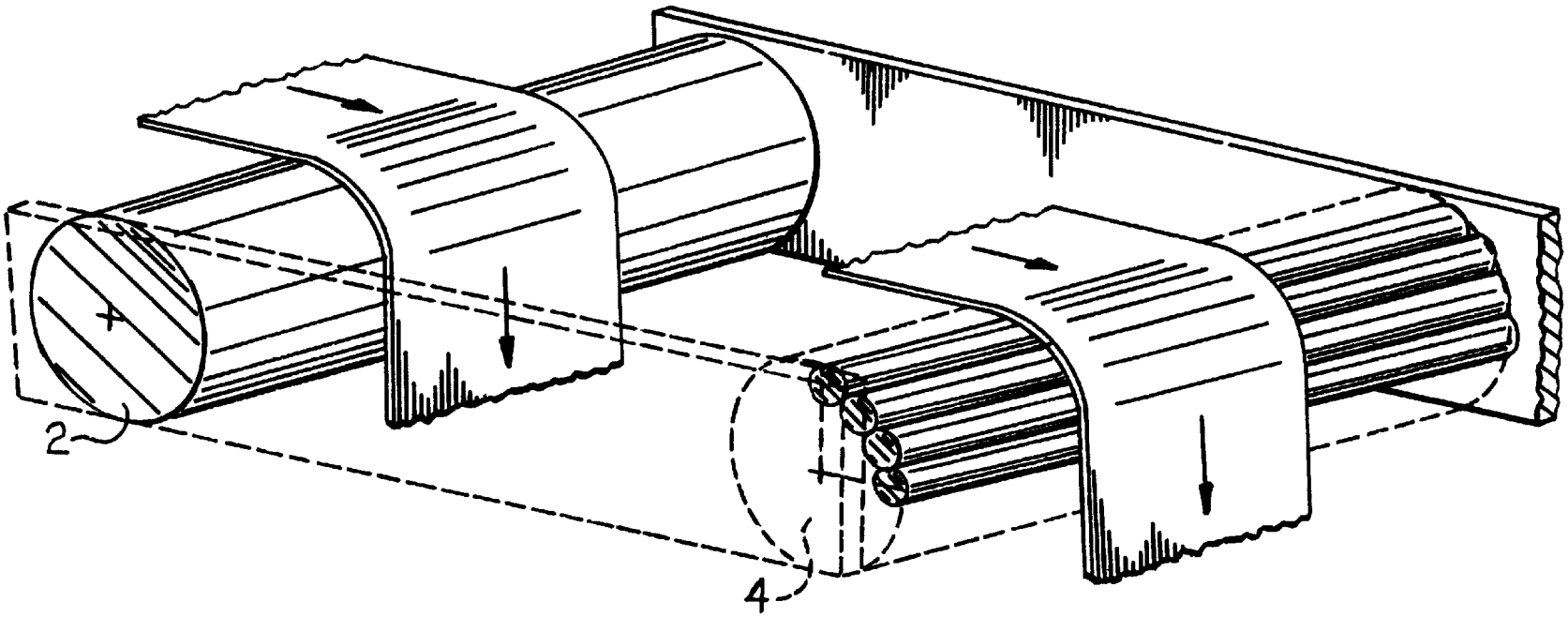
FIG. 1 PRIOR ART
FIG. 1 is a perspective view of a prior art deflector roll and a prior art quadrant roll.
Figure 2:
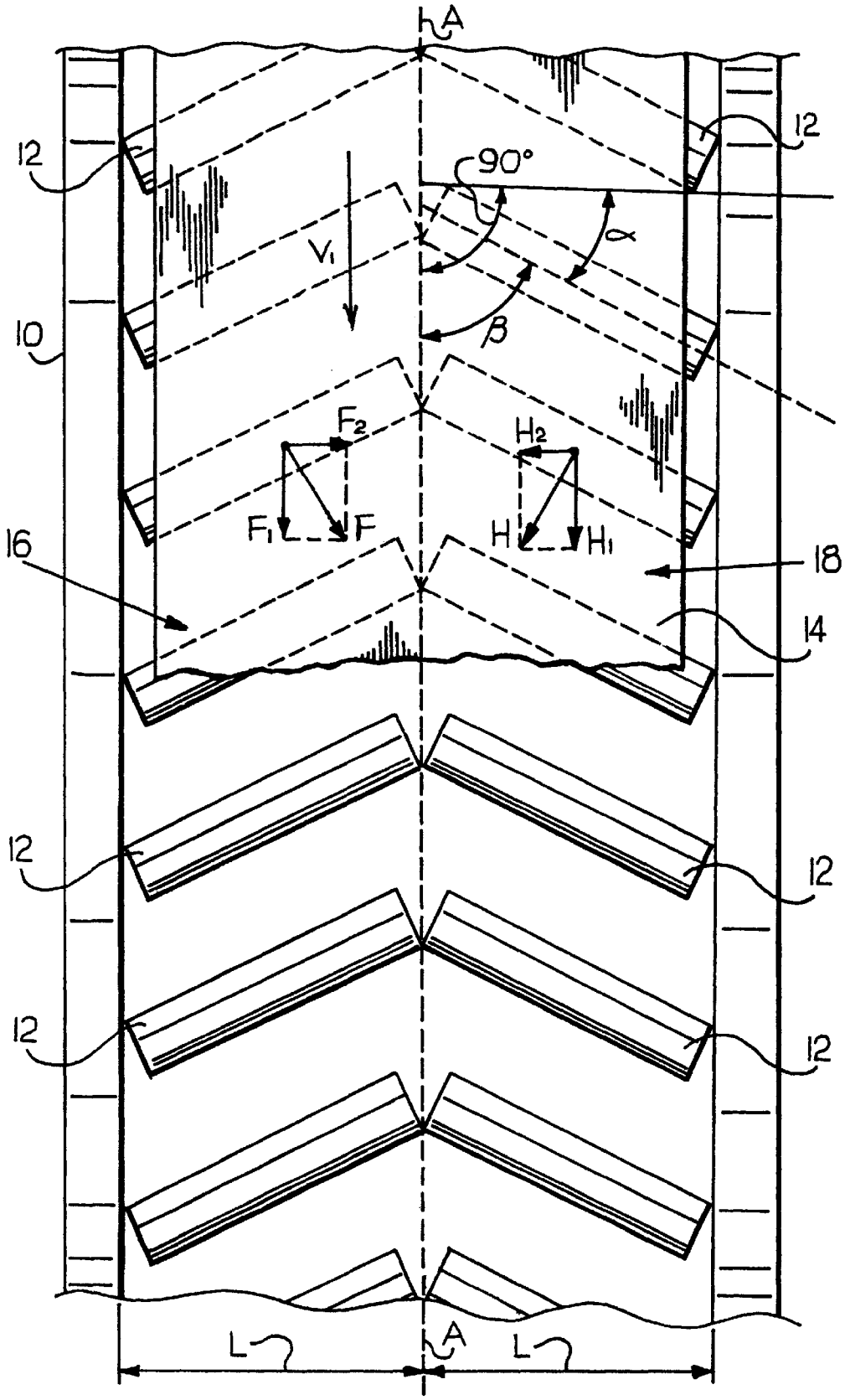
FIG. 2 is a plan view schematically showing a prior art horizontal (flat) roll conveyor having a plurality of rolls arranged in a herringbone configuration.

Referring again to FIG. 2, it will be apparent to those skilled in the art that the centering effect of the herringbone or chevron arrangement becomes greater the smaller the angle β becomes. As shown in the resolution of forces diagram in FIG. 2, as the angle β decreases, the horizontal and opposite forces $F_2$ and $H_2$ will increase and enhance the centering effect. Additionally, as previously explained, the further out of center the strip 14 moves, the greater the centering force, either $F_2$ or $H_2$, becomes and urges the strip 14 toward the conveyor centerline A—A.

Figure 9:
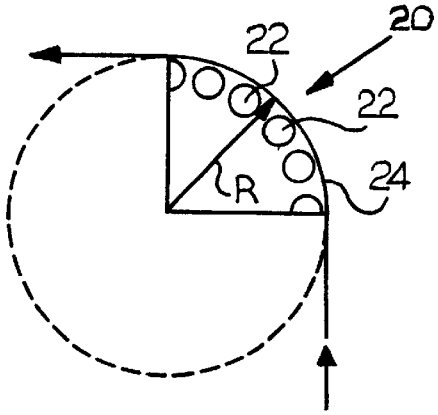
FIG. 9 is a side view schematically showing a 90° quadrant roll conveyor made in accordance with the present invention and intended to replace the steering roll of FIG. 6.
Figure 10:
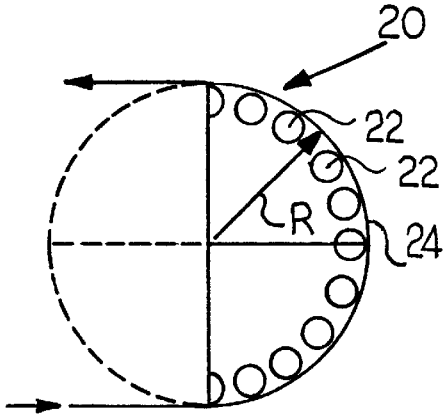
FIG. 10 is a side view schematically showing a 180° quadrant roll conveyor made in accordance with the present invention and intended to replace the steering roll of FIG. 7.
Figure 11:
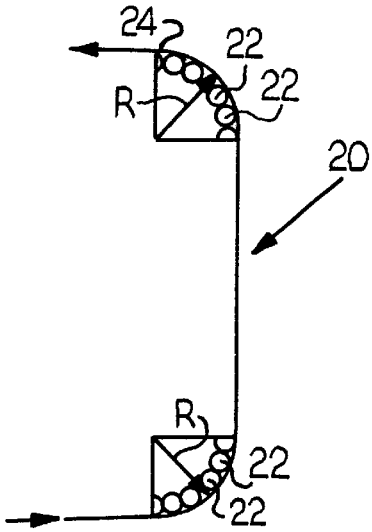
FIG. 11 is a side view schematically showing a 180° quadrant roll made in accordance with the present invention and intended to replace the steering roll of FIG. 8.

Referring now to FIGS. 9–11, in a similar manner, the higher the tension in the strip 24 as it traverses around the conveyors 20 made in accordance with the present invention, the greater the forces $F_2$, $H_2$ (shown in FIG. 2) become resulting in increasing the centering effect of the conveyors 20.

Figure 15:
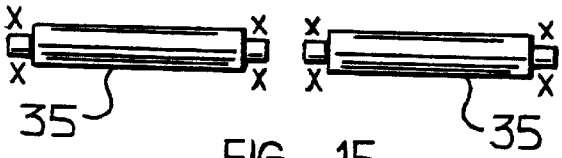
FIG. 15 PRIOR ART
FIG. 15 is a front view of the prior art straight cylindrical rolls used in the quadrant roll conveyor of FIG. 14*b;*

Referring again to FIGS. 12 and 13, the herringbone or chevron configuration previously described has not been extended beyond its application in horizontal roll conveyors because as the straight cylindrical rolls 22 shown in FIGS. 12 and 13 are assembled with smaller angles β, the surfaces of the straight cylindrical rolls 22 no longer define a flat semicircular or quadrant arc, i.e., a flat surface profile around the arc. In other words, the surface of the conveyors 20 no longer equates to the relatively straight profile defined by the surface of a cylindrical deflector roll, as shown in FIGS. 6–8. In contrast, the surface of the conveyors 20 with straight cylindrical rolls will be equivalent to a cylindrical deflector roll with a surface profile defined by two (2) TORO edges as shown in FIG. 14*b*. In summary, the herringbone or chevron arrangement using straight cylindrical rolls does not provide a flat conveying surface for strip material over a semicircular or quadrant arc. FIG. 15 shows typical straight cylindrical rolls 35 that are generally used in horizontal roll conveyors. The present invention overcomes also the inherent disadvantages of the straight cylindrical rolls 35 when used in the conveyors 20 by substituting the straight cylindrical rolls 35 with profiled rolls 35', 35" shown in FIGS. 16–18 in the herringbone or chevron configuration of the conveyor 20.

Figure 16A:
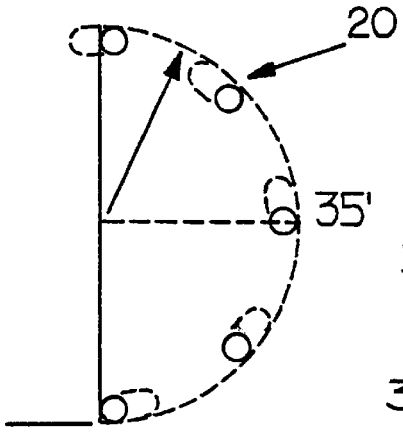
FIG. 16*a* is a side view schematically showing a quadrant roll conveyor made in accordance with the present invention having crowned rolls.
Figure 16B:
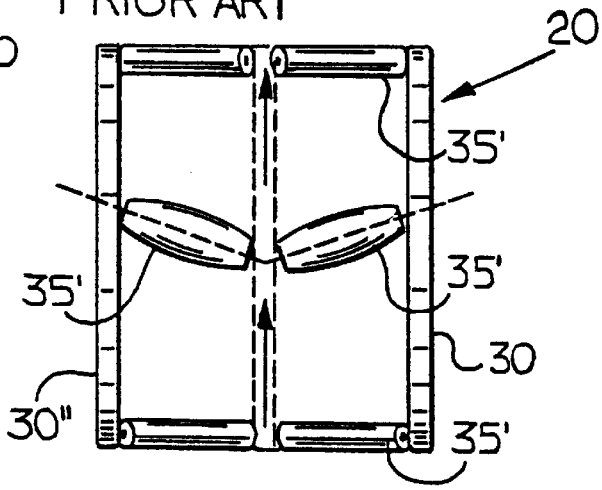
FIG. 16*b* is a plan view of the quadrant roll conveyor of FIG. 16*a;*
Figure 17:
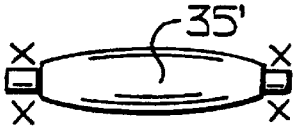
FIG. 17 is a front view of the crowned rolls used in the quadrant roll conveyor of FIG. 16*b;*

FIGS. 16 and 17 show profiled rolls 35' in accordance with the present invention that are crowned in the longitudinal direction. The crowned rolls 35' generate a straight cylindrical profile when applied in the herringbone arrangement in the conveyors 20. The degree of crowning C for the rolls 35' is a function of the angle β. An appropriate and acceptable value of the maximum value of the crown C for each of the rolls 35' can be obtained using the following approximate formula:

$$C = R\left(1 - \cos\left(\arcsin\left(\frac{L}{2R}\sin\alpha\right)\right)\right),$$

wherein is the complementary angle to the angle β that is defined between the conveyor centerline A—A and the respective roll 35' centerline or axis of rotation; wherein L is a distance between the conveyor centerline A—A and one of the support members 30, 30"; and wherein R is a radius of the quadrant roll conveyors 20 as shown in FIGS. 9–11.

Figure 18A:
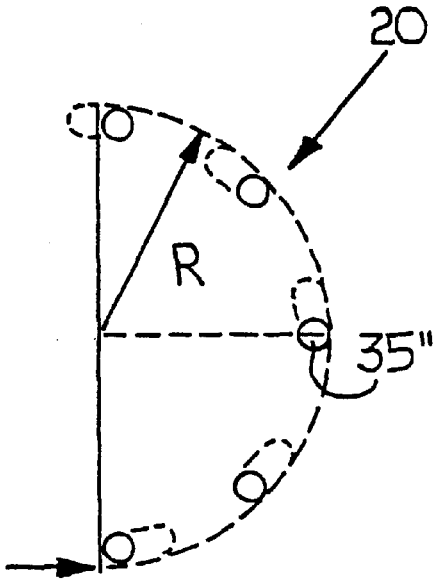
FIG. 18*a* is a side view schematically showing a quadrant roll conveyor made in accordance with the present invention having profiled rolls.
Figure 18B:
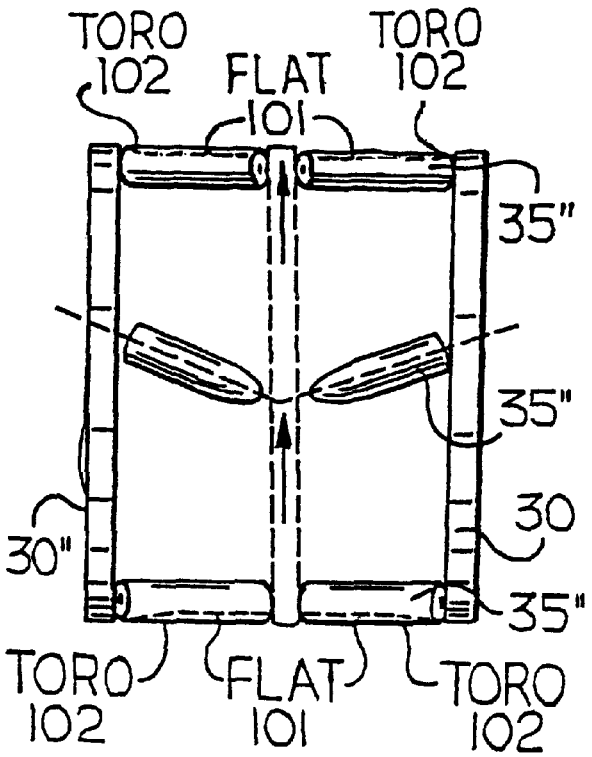
FIG. 18*b* is a plan view of the quadrant roll conveyor of FIG. 18*a*.
Figure 19:
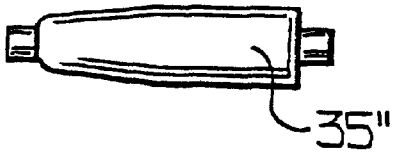
FIG. 19 is a front view of the profiled rolls used in the quadrant roll conveyor of FIG. 18*b*.

FIGS. 18 and 19 show profiled rolls 35" with crowning only on a central part of the profiled rolls 35". With this type of crown, it is possible to have a flat or straight cylindrical profile in the center of a conveyor 101 and TORO profiles on edges 102. As shown in FIG. 19, a first portion of the roll 35" is cylindrical and a second portion of the roll 35" is tapered or crowned. This design will increase the strip centering effect and generate more pressure and centering forces when a strip (not shown) is "walking" out of center on the conveyors 101.

The conveyors 20, preferably having rolls 35' or rolls 35", is used to convey strip material as discussed hereinafter. Referring to FIGS. 10, 12 and 13, the strip 24 is positioned onto the rolls 22 such that the strip 24 contacts the surfaces of the rolls 22. Preferably, the rolls 22 are not driven. The strip 24 is generally located between the outer support members 30, 30" and is under tension to place the strip 24 firmly in contact with the surfaces of the rolls 22. The tension in the strip 24 preferably provides motive forces to the strip 24 causing the strip 24 to move in a conveying direction, indicated by arrows in FIG. 10. The tension in the strip 24 and the frictional interaction between the strip 24 and the surfaces of the rolls 22 cause the rolls 22 to rotate. The tensioned strip 24 moves along the surfaces of the rotating rolls 22 and in the conveying direction around the semicircular or quadrant arc defined by the conveyors 20. In FIGS. 10, 12 and 13, the quadrant arc is a 180° arc. Due to the herringbone or chevron orientation of the rolls 22, the strip 24 is centered to the centerline A—A of the conveyors 20 as the strip 22 traverses around the semicircular arc defined by the rolls 22. As stated previously, the quadrant arc or quadrant roll is not limited to a wrapping angle of between 90° and 180° and can be any desired wrapping angle.

With the quadrant roll conveyors 20 according to the present invention, it is possible to replace existing prior art steering/centering rolls that are activated with an electro-hydraulic unit. No electro-hydraulic unit is necessary and the related installation and maintenance costs are significantly reduced by the present invention. The quadrant roll conveyors 20 made according to the present invention provides strip centering action to strip material around an "arc" or "roll" of any desired wrapping angle. Additionally, it is not intended to limit the present invention to the transport of metal strip, but relates to the transport of strip material generally.

Although this invention has been described with reference to preferred embodiments, obvious modifications and alterations of the invention may be made without departing from the spirit and scope of the invention. The scope of the present invention is defined by the appended claims and equivalents thereto.

What is claimed is:

1. A quadrant roll conveyor for conveying strip material around a quadrant roll of any desired wrapping angle, comprising:

support means; and a plurality of rolls journaled for rotation in the support means, with the rolls arranged in a plurality of roll pairs, with the respective rolls in the roll pairs positioned on opposite sides of a conveyor centerline, and with the rolls in the roll pairs having separate, straight shafts positioned at an angle of less than 90° with the conveyor centerline such that the rolls, in combination, define a chevron pattern around the wrapping angle, wherein the strip material is continuously centered on the conveyor around the wrapping angle by the action of the rolls when the conveyor transports the strip material.

2. The quadrant roll conveyor of claim 1, wherein the shafts of the rolls in the roll pairs have an axis of rotation intersecting the axis of rotation of the corresponding shaft located on the opposite side of the conveyor centerline at a point in a vertical plane passing through the conveyor centerline.

3. The quadrant roll conveyor of claim 2, wherein each of the rolls is crowned in a longitudinal direction.

4. The quadrant roll conveyor of claim 2, wherein each of the rolls is tapered in a longitudinal direction.

5. The quadrant roll conveyor of claim 2, wherein a first portion of each of the rolls in a longitudinal direction is cylindrical and a second portion of each of the rolls in the longitudinal direction is tapered.

6. The quadrant roll conveyor of claim 1, wherein each of the roll is crowned in a longitudinal direction.

7. The quadrant roll conveyor of claim 1, wherein each of the rolls is tapered in a longitudinal direction.

8. The quadrant roll conveyor of claim 1, wherein a first portion of each of the rolls in a longitudinal direction is cylindrical and a second portion of each of the rolls in the longitudinal direction is tapered.

9. The quadrant roll conveyor of claim 1, wherein the wrapping angle is 180°.

10. The quadrant roll conveyor of claim 1, wherein the wrapping angle is 90°.

11. A quadrant roll conveyor for conveying strip material around a quadrant roll of any desired wrapping angle, comprising:

three substantially parallel support members, with one of the support members positioned coaxial with a conveyor centerline; and a plurality of rolls, wherein each of the rolls is journaled for rotation in two of the three support members, wherein the rolls are arranged in a plurality of roll pairs, with the respective rolls in the roll pairs positioned on opposite sides of the conveyor centerline, wherein the rolls in the roll pairs have a separate, straight shafts positioned at an angle of less than 90° with the conveyor centerline such that the rolls, in combination, define a chevron pattern around the wrapping angle, wherein the strip material is continuously centered on the conveyor around the wrapping angle by the rolls when the conveyor transports the strip material, and wherein the shafts of the rolls in the roll pairs have an axis of rotation intersecting the axis of rotation of the corresponding shaft located on the opposite side of the conveyor centerline at a point in a vertical plane passing through the conveyor centerline.

12. The quadrant roll conveyor of claim 11, wherein each of the rolls is crowned in a longitudinal direction.

13. The quadrant roll conveyor of claim 12, wherein a maximum value for crowning of each of the rolls is determined by the following formula:

$$C = R\left(1 - \cos\left(\arcsin\left(\frac{L}{2R}\sin\alpha\right)\right)\right)$$

wherein  is a complementary angle to the angle defined between the conveyor centerline and axis of rotation of the shafts of the rolls in the roll pairs, wherein L is a distance between the conveyor centerline and one of the support members, and wherein R is a radius of the quadrant roll.

14. The quadrant roll conveyor of claim 11, wherein each of the rolls is tapered in a longitudinal direction.

15. The quadrant roll conveyor of claim 11, wherein a first portion of each of the rolls in a longitudinal direction is cylindrical and a second portion of each of the action of the rolls in the longitudinal direction is tapered.

16. The quadrant roll conveyor of claim 11, wherein the wrapping angle is 180°.

17. The quadrant roll conveyor of claim 11, wherein the wrapping angle is 90°.

18. A method of using a quadrant roll conveyor to convey strip material around a quadrant roll of any desired wrapping angle, comprising the steps of:

providing the quadrant roll conveyor, with the conveyor further comprising:

three substantially parallel support members, with one of the support members positioned coaxial with a conveyor centerline; and a plurality of at least partially crowned rolls, wherein each of the rolls is journaled in two of the three support members, wherein the rolls are arranged in a plurality of roll pairs, with the respective rolls in the roll pairs positioned on opposite sides of the conveyor centerline, and wherein the rolls in the roll pairs have separate, straight shafts positioned at an angle of less than 90° with the conveyor centerline such that the rolls, in combination, define a chevron pattern around the wrapping angle;

positioning the strip material on the conveyor;

tensioning the strip material such that the strip material moves in a conveying direction around the quadrant roll defined by the conveyor; and continuously centering the strip material on the conveyor around the wrapping angle with the rolls.

19. The method of using a quadrant roll conveyor to convey strip material around a quadrant roll of claim 18, wherein the wrapping angle is 180°.

20. The method of using a quadrant roll conveyor to convey strip material around a quadrant roll of claim 18, wherein the wrapping angle is 90°.

* * * * *

UNITED STATES PATENT AND TRADEMARK OFFICE

CERTIFICATE OF CORRECTION

PATENT NO. : 6,457,623 B1
DATED : October 1, 2002
INVENTOR(S) : Giorgio A. Rey

It is certified that error appears in the above-identified patent and that said Letters Patent is hereby corrected as shown below:

Title page,
Item [57], ABSTRACT,
Line 11, "are profiled" should read -- are preferably profiled --

Column 4,
Line 7, "angle ," should read -- angle $\propto$, --.

Column 6,
Line 28, "wherein is" should read -- wherein $\propto$ is --.

Column 8,
Line 29, "wherein is" should read -- wherein $\propto$ is --.

Signed and Sealed this

Twenty-ninth Day of April, 2003

JAMES E. ROGAN
*Director of the United States Patent and Trademark Office*